US007708680B2

(12) United States Patent
Just et al.

(10) Patent No.: US 7,708,680 B2
(45) Date of Patent: May 4, 2010

(54) METHOD AND ARRANGEMENT IN CARDBOARD CREASING

(75) Inventors: Magnus Just, Glumslöv (SE); Michael Wennbom, Glumslöv (SE)

(73) Assignee: Tetra Laval Holdings & Finance S.A., Pully (CH)

( * ) Notice: Subject to any disclaimer, the term of this patent is extended or adjusted under 35 U.S.C. 154(b) by 118 days.

(21) Appl. No.: 11/918,207

(22) PCT Filed: Apr. 4, 2006

(86) PCT No.: PCT/SE2006/000404

§ 371 (c)(1),
(2), (4) Date: Oct. 11, 2007

(87) PCT Pub. No.: WO2006/112767

PCT Pub. Date: Oct. 26, 2006

(65) Prior Publication Data

US 2009/0054220 A1 Feb. 26, 2009

(30) Foreign Application Priority Data

Apr. 19, 2005 (SE) ..... 0500897

(51) Int. Cl.
*B31B 1/25* (2006.01)

(52) U.S. Cl. ..... 493/403; 493/396; 493/400; 493/401; 493/402; 493/404

(58) Field of Classification Search ..... 493/395–396, 493/400–404, 471
See application file for complete search history.

(56) References Cited

U.S. PATENT DOCUMENTS 4,795,414 A * 1/1989 Blumle ..... 493/403
5,123,891 A * 6/1992 Nieradka et al. ..... 493/370
5,133,235 A * 7/1992 DeVito ..... 83/347
5,194,064 A * 3/1993 Simpson et al. ..... 493/402
5,393,295 A * 2/1995 Knecht ..... 493/403
5,509,885 A 4/1996 Brunlid
5,704,886 A 1/1998 Sampaolo et al.
5,840,002 A * 11/1998 Happ ..... 493/399
5,888,183 A * 3/1999 Ruthenberg et al. ..... 493/366
5,954,625 A * 9/1999 Giesler, Sr. ..... 493/396
5,971,266 A * 10/1999 Sampaolo et al. ..... 229/137
6,071,225 A * 6/2000 Kucharski ..... 493/471
6,162,155 A * 12/2000 Gordon et al. ..... 493/59
6,994,662 B2 * 2/2006 Jornborn et al. ..... 493/56
2004/0259709 A1 12/2004 Guidotti et al.

OTHER PUBLICATIONS

International Search Report dated Jul. 17, 2006.

* cited by examiner

*Primary Examiner*—Christopher Harmon
(74) *Attorney, Agent, or Firm*—Buchanan Ingersoll & Rooney PC

(57) ABSTRACT

The present invention relates to a method and an arrangement in a cardboard creasing machine performing creases on a cardboard blank web. The web has a width of at least two lanes of blanks in parallel to each other and comprise in at least one zone per pair of lanes an area where intentional creases on both are made transversally to a feeding direction of the machine. The crease-lines are on the male side interrupted to provide a longitudinal seal strip to an edge of each blank to become. The cardboard web is in a limited area of such an interruption intentionally and positively lifted and supported from the side of a female crease die to a level in between being in line with to being above an outermost surface of a female crease die roller of the machine.

18 Claims, 3 Drawing Sheets

METHOD AND ARRANGEMENT IN CARDBOARD CREASING

TECHNICAL FIELD OF THE INVENTION

The present invention relates to a method and an arrangement in cardboard creasing when performing creases on a cardboard web fed from a large roller, where said web comprise the width of at least two blanks in parallel to each other. More precisely the invention relates to measures taken in connection with creasing wear tools that normally cooperate in pairs in creating a certain crease pattern to lanes of coherent package blanks, made from cardboard.

TECHNICAL BACKGROUND

Cardboard creasing is, as is well known in the art, made for facilitating folding of a material, which folding is to be performed after having made a pattern of crease lines thereon. Blanks for packages are sometimes like here prepared from wide webs comprising at least two blanks in parallel to each other. Within the packaging industry the term "blank" refers to a portion of a packaging material needed to form one package. A web comprises longitudinal lanes of blanks. The width of one lane equals the length or the width of one blank. When producing liquid food products containing for example water, these have to be contained in a more or less liquid proof package. For many years laminates comprising cardboard and polymer materials has been used for this purpose with an excellent result. When, however, producing cardboard packages of increased volumes, for instance such containing 1.5 liters or more, the stress on the material becomes larger and thus the thickness of the cardboard has to be increased.

As a result of the increased thickness there is a tendency of the cardboard material, while influenced by positively progressing male and female dies as well as different types of rollers in the feeding process thereof, which is positively progressing the cardboard material, to create what is called wild-creases. A wild-crease is an unwanted self-generated crease-like deformation or a defibration of a cardboard material between two adjacent intentionally made creases and seems to be the result of a necessary combination of high compression stresses to create the intentional creases, the mutual distance between the separated adjacent creases, the depth of each crease and the thickness of the creased material. This gives rise to shear stresses in the pulp layers of the cardboard material, which may cause delamination or defibration thereof, which in turn may produce the wild-creases. The wild-creases occur mainly between two coherent lanes in the modified offset printing process that constitutes the creasing process.

The wild-creases appears as an uncontrolled wrinkling of the cardboard in an area between two from one another independent co-linear male dies and more specifically between two separated crease lines, one on each blank. The crease lines can be realized by a crease-roller system well known to the skilled person and in such case the two separated crease lines are transversal to the tangential direction of any point of a crease plate in it's rotational direction. This is clearly shown in FIG. 6 of the attached drawings belonging to this description. It is desired to avoid wild-creases occurring on a package blank in an area where a longitudinal seal is to be made. Such wild-creases might and do in some cases constitute a risk that the package thus produced will show channels in the seal. Channels lead to a loss of product integrity. These phenomena are of course not acceptable neither from a producers point of view nor from the same of a consumer.

BACKGROUND ART

In performing a scan regarding the state of the art regarding methods and/or arrangements dealing with the problem thus described, no relevant material was found.

SUMMARY OF THE INVENTION

A main object of the work that has resulted in the present invention has therefore been to provide a method and an arrangement that makes it possible to eliminate any risk of creation of wild creases, when it, due to factors such as required larger structural rigidity is required to make use of a thicker material for producing packages.

According to the invention this and other objects of the invention are achieved by the fact that the cardboard blank web (7) in a limited area of such an interruption is intentionally and positively elevated and supported from the side of a female crease die (in Z-direction=ZD) to a level coinciding with or above an outermost surface of the female crease die. Hereby the tensile stress of the material is released and no delamination or defibration will occur spontaneously.

BRIEF DESCRIPTION OF THE DRAWINGS

In the following the invention will be described in more detail, having reference to a preferred embodiment thereof shown in the attached drawings, in which.

DETAILED DESCRIPTION OF A PREFERRED EMBODIMENT

The technology representative to the present invention relates to a case where it is aimed to create unfolded package blanks from a large roller containing a preferably preprinted, cardboard web material of a width equaling at least the width of two package blanks.

Figure 1:
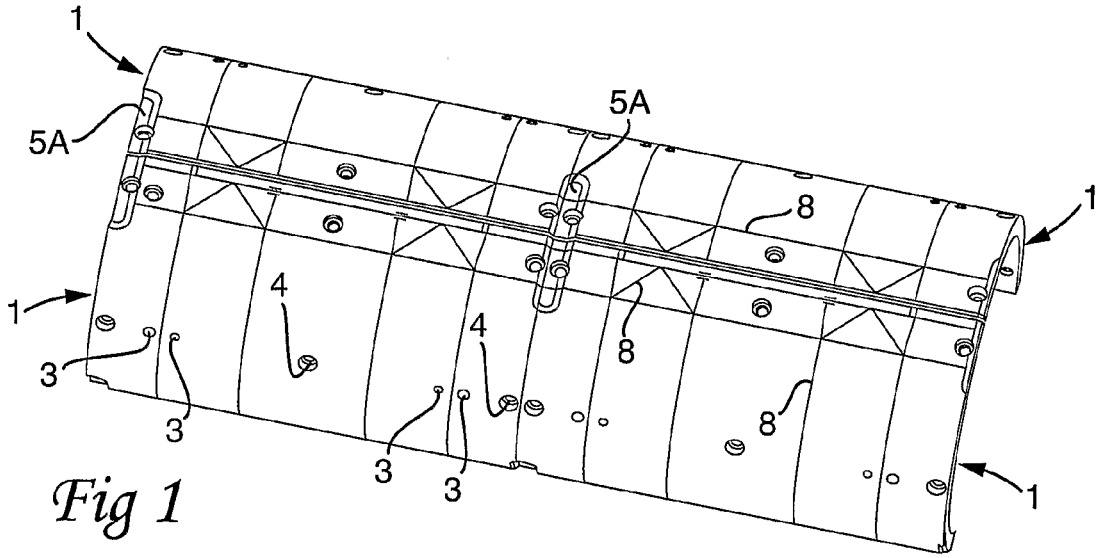
FIG. 1 shows an isometric view of two pairs of male creasing plates to be comprised in and as such fixed to a roller in a creasing station of a packaging machine.

FIG. 1 thus shows two pairs of male creasing plates 1, each of which are aimed for a prefabricated, i.e. printed, blank (not shown). It may here in parenthesis be mentioned that the creasing plates 1, each having the shape of a semi cylindrical shell, are to be rigidly mounted by for instance bolts to a roller (not shown) for a long but anyway nevertheless limited life as a wear-plate. These wear-plates are designed to be used for a certain amount of repetitions and are thereafter recycled. It should for clarification purposes be mentioned that wear plates by no means are necessary. The creasing pattern may also be formed directly on the rollers. The creasing plates shown here are of a shape giving rise to four package blanks per revolution and lane. The number of lanes in a setup is limited by the width of the cardboard roller used. The setup here shown thus gives rise to eight blanks per revolution. Between the plates in a specific region where creases transversal to a machine direction (to be defined later) the male crease plate shows countersunk portions 5A aimed to cooperate with cantilevers 5B to be defined below, to avoid interference when male and female dies meet and counteract.

Figure 2:
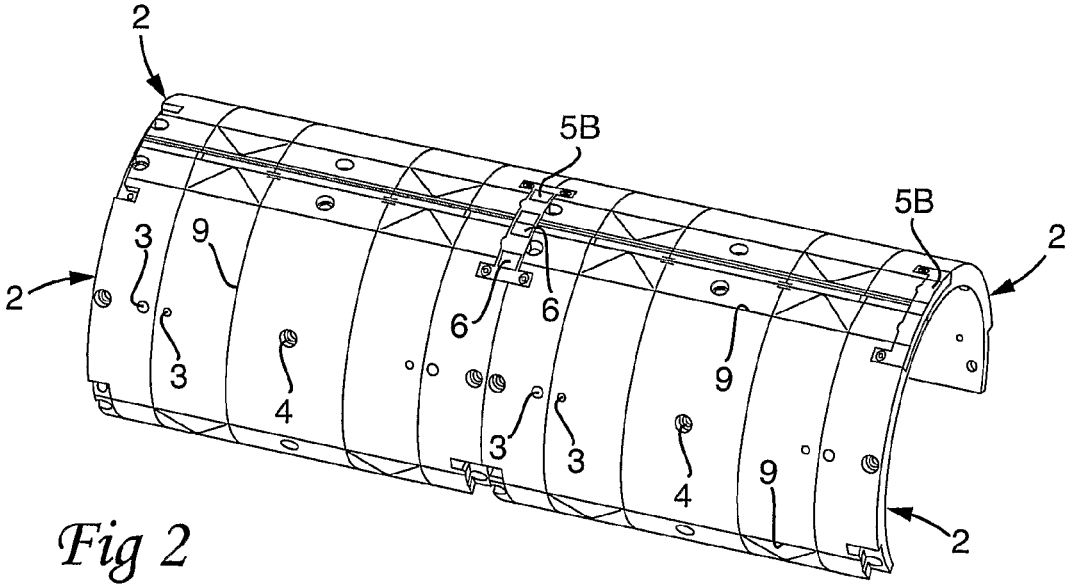
FIG. 2 shows an isometric view of two pairs of female creasing plates aimed at cooperating with the plates shown in FIG. 1.

According to FIG. 2 there is shown a set of female creasing plates 2, correspondingly and invertedly set up as compared to the male plates 2 shown earlier, to interact therewith in the formation of intentional creases. Each of the creasing plates 1 and 2 are provided with a number of holes 3 and cavities 4, where the holes 3 are provided to constitute means for correctly aligning the plates 1 or 2 to it's respective roller and the cavities 4 are provided to constitute countersunk cavities for the fitting of bolts for obtaining a secure fixation of the plates 1 or 2 to it's respective roller (not shown).

Figure 3:
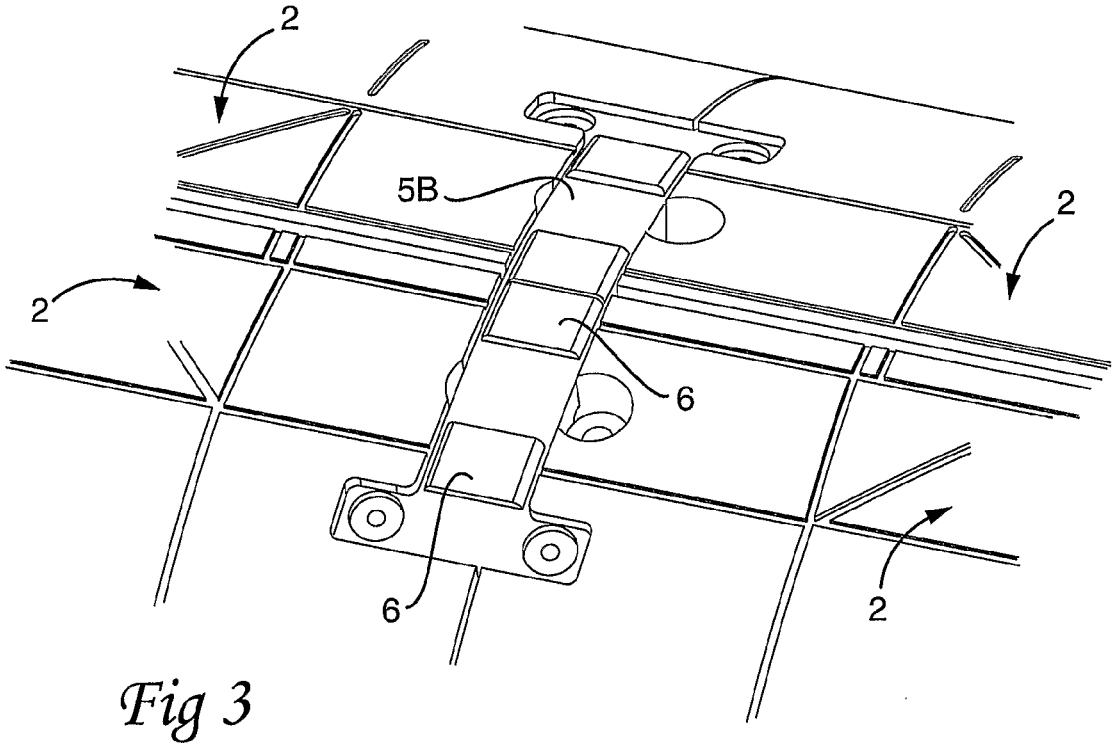
FIG. 3 shows an enlarged view of a part of the above initially mentioned female plates.

FIG. 3 shows a detailed partial view from FIG. 2 of the main issue of the invention, namely a so-called cantilever 5B, here bolted to the female creasing plate 2. The cantilever 5B has the shape of a large I standing in the peripheral direction of the plate 2 and enclose a borderline between two female plates 2 to a part. The surface of said cantilever facing outwards in it's mounted condition comprise a number of elevated portions 6, the purpose of each is to elevate or lift the cardboard 7 an amount of on or around 5 mm from it's free state along the outermost surface of the female crease plate in the volume between the creasing plates 1 and 2, to counteract the tensile stress in the cardboard material in the vicinity of the ends of each of the male crease protrusions, while pressing permanent creases in counteraction with the crease recesses of the female crease plate 2. By outermost surface of the female crease die is meant the predominating surface of the female crease die above the dies. By doing so the occurrence of wild creases in the vicinity of this area are eliminated or at least diminished. It should be noted that the elevated portions 6 also might be produced in one piece with the roller, which in some way comprise the female crease pattern.

Figure 4:
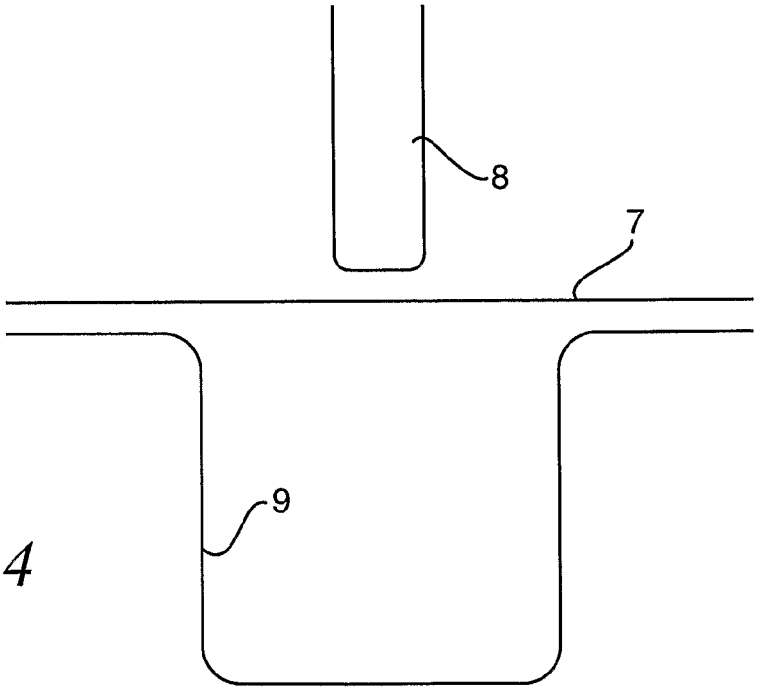
FIG. 4 shows a situation before the creation of a crease between two elements of a male and a female crease die respectively, before making use of the teachings of the invention.
Figure 5:
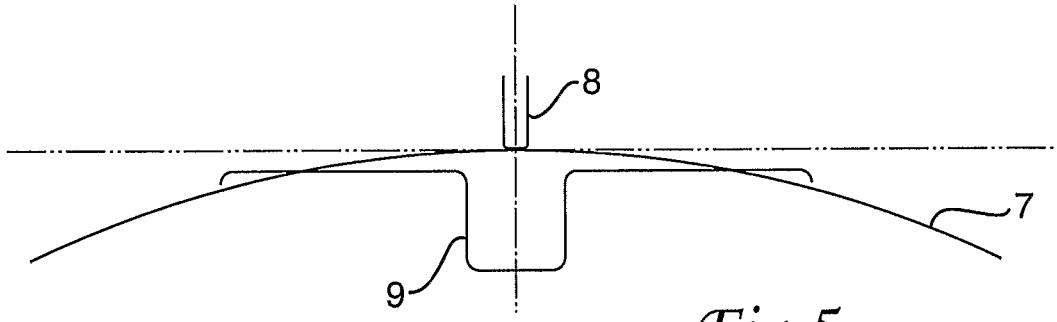
FIG. 5 shows a view similar to FIG. 4 but in which the teachings of the invention is implemented.
Figure 6:
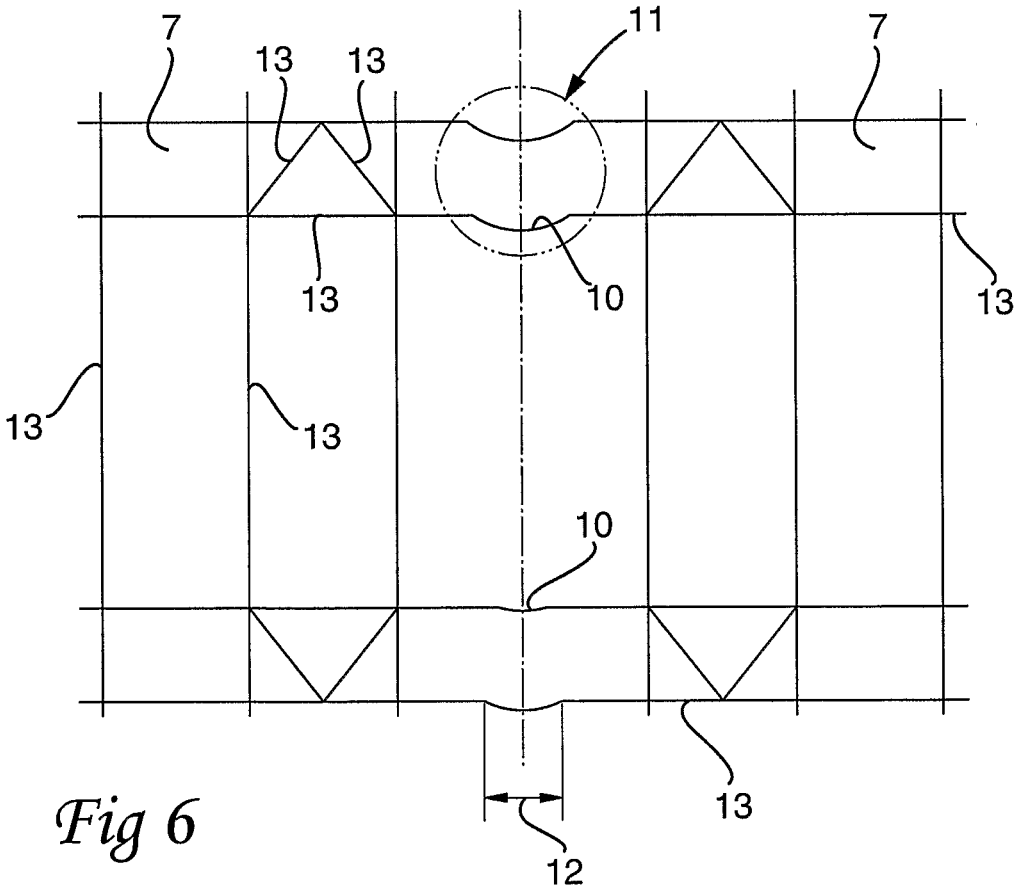
FIG. 6 shows, partially as an enlargement, a situation according to prior teachings, where unintentional wild-creases have emerged between two lanes of creased blanks.

To provide a better understanding of how this is achieved, FIGS. 4 and 5 are produced. According thereto a blank of a cardboard material 7 is shown interlaced between an approximately 0.5 mm wide conventionalized male die 8 and a likewise conventionalized female die 9 having a width of around 2 mm. A coordinate symbol is shown bearing a sign ZD for Z-direction, i.e. a direction normal to and directed from the female crease die roller "upwards" and MD for Machine-Direction, i.e. the direction in which the cardboard 7 is transported. Thus it is shown that the respective dies here are transversal to said transport direction. If here the male die 8 suddenly ends, which is the case where the aim is to create a sealing area along which later to provide a longitudinal seal, the cardboard material 7 experiences a sudden loss of counter support and will as a consequence thereof suddenly tend to spontaneously create "wild-creases" 10, as previously explained. This is more clearly shown in FIG. 6 even as an enlargement at 11 along the length 12, where the neighborhood between two blanks lack an intentionally made male crease. Here, however, the material has by itself during the creasing operation developed a wild-crease 10. By the insertion of the cantilever 5B, as is illustrated in FIG. 5, and thereby achieving a positive elevation of the material approximately 5 mm above the outer envelope surface of the female die 9 in the specific area where the male die 8 ends, no more such wild-creases will spontaneously occur.

The invention claimed is:

1. Arrangement in a cardboard creasing machine comprising a system of at least a rotatable first roller and a rotatable second roller each possessing an outer surface which together define cooperating creasing dies creating a crease pattern on each and every blank of a cardboard web of coherent such blanks positively run through the creasing machine and passed between the first and second rollers, the creasing dies comprising an outwardly projecting male creasing die extending circumferentially on the first roller and an inwardly recessed female creasing die extending circumferentially on the second roller, the first roller and the second roller being positioned in confronting relation to each other with the male creasing die and the female creasing die aligned with one another and cooperating with one another during rotation of the first and second rollers to produce the crease pattern on the cardboard web passing between the first and second rollers, the first roller including an interruption area at which the circumferentially extending male creasing die is interrupted to produce an interruption in the crease pattern of the web at a portion of the web that is to form an overlap seal, a portion of the circumferentially extending female creasing die which cooperates with the interruption area being provided with a cantilever arrangement which supports the cardboard web on a level coinciding with or radially outwardly of an outermost surface of the second roller to avoid wild creases on the cardboard web.

2. Arrangement according to claim 1, wherein the cantilever arrangement is located in the inwardly recessed female crease die.

3. Arrangement according to claim 1, wherein the cantilever arrangement includes a locally increased height extending outwardly from the outermost surface of the second roller by around 5 mm.

4. Arrangement according to claim 1, wherein the male creasing die has a countersink corresponding in circumferential position to the locally increased height of the second roller.

5. Arrangement according to claim 1, wherein the cantilever arrangement is arranged in a central position, relative to a longitudinal extent of the second roller, exactly in line with the interrupted area of the first roller.

6. Arrangement according to claim 1, wherein the male creasing die is provided on a male creasing plate connected to the first roller.

7. Arrangement according to claim 1, wherein the female creasing die is provided on a female creasing plate connected to the second roller.

8. Arrangement according to claim 1, wherein the male creasing die is provided on a male creasing plate connected to the first roller and the female creasing die is provided on a female creasing plate connected to the second roller.

9. Arrangement according to claim 1, wherein a circumferential extent of the cantilever arrangement is limited to the portion of the circumferentially extending female creasing die which cooperates with the interruption area.

10. Arrangement in a cardboard creasing machine which produces crease patterns on a cardboard web, the arrangement comprising at least a rotatable first roller and a rotatable second roller positioned in opposing relation to one another and each possessing an outer surface presenting cooperating creasing dies which produce the crease patterns on each and every blank of the cardboard web as the cardboard web passes between the first and second rollers, the creasing dies comprising outwardly projecting male creasing dies extending circumferentially and longitudinally on the first roller, and inwardly recessed female creasing dies extending circumferentially and longitudinally on the second roller, the first roller and the second roller being positioned relative to one another such that each of the male creasing dies is aligned with and cooperates with one of the female creasing dies during rotation of the first and second rollers to produce the crease patterns on the cardboard web as the cardboard web passes between the first and second rollers, at least some of the circumferentially extending male creasing dies including a circumferentially extending interruption area at which the circumferentially extending male creasing die is interrupted to produce interruptions in the crease patterns of the web at portions of the cardboard webs that are to form an overlap seal, portions of the circumferentially extending female creasing dies which cooperate with the interruption areas being provided with a cantilever extending radially outwardly to a level coinciding with or radially outwardly of an outermost surface of the second roller to support the cardboard web and avoid wild creases on the cardboard web.

11. Arrangement according to claim 10, wherein the cantilever is bolted in place on the first roller.

12. Arrangement according to claim 10, wherein the cantilever possesses an outer surface defining a locally increased height positioned outwardly from the outermost surface of the second roller by around 5 mm.

13. Arrangement according to claim 12, wherein each male creasing die has a countersink corresponding in circumferential position to the locally increased height of the second roller.

14. Arrangement according to claim 10, wherein the cantilevers are arranged in a central position, relative to a longitudinal extent of the second roller, exactly in line with respective one of the interrupted areas of the first roller.

15. Arrangement according to claim 10, wherein the male creasing die is provided on a male creasing plate which is separate from the first roller and connected to the first roller.

16. Arrangement according to claim 10, wherein the female creasing die is provided on a female creasing plate which is separate from the second roller and connected to the second roller.

17. Arrangement according to claim 10, wherein the male creasing die is provided on a male creasing plate which is separate from the first roller and connected to the first roller, and the female creasing die is provided on a female creasing plate which is separate from the second roller and connected to the second roller.

18. Arrangement according to claim 10, wherein a circumferential extent of each of the cantilevers is limited to the portion of the respective circumferentially extending female creasing die which cooperates with the interruption area.

* * * * *